United States Patent [19]

Colston

[11] 4,208,152

[45] Jun. 17, 1980

[54] DIVER SUPPORT APPARATUS

[75] Inventor: John R. Colston, Annapolis, Md.

[73] Assignee: Westinghouse Electric Corp., Pittsburgh, Pa.

[21] Appl. No.: 953,504

[22] Filed: Oct. 23, 1978

Related U.S. Application Data

[63] Continuation-in-part of Ser. No. 733,744, Oct. 19, 1976, abandoned.

[51] Int. Cl.[2] ..... B63C 11/02

[52] U.S. Cl. ..... 405/186; 126/204

[58] Field of Search ..... 405/185, 186, 190, 191; 114/312, 314, 315; 126/204; 137/236.5; 165/45, 48 R; 237/1

[56] References Cited

U.S. PATENT DOCUMENTS

| | | | |
|---|---|---|---|
| 1,466,315 | 8/1923 | Thorsen . | |
| 2,107,933 | 2/1938 | Crockett et al. | 237/1 |
| 2,764,147 | 9/1956 | Brunner | 126/247 |
| 3,003,448 | 10/1961 | Gay | 114/337 |
| 3,103,195 | 9/1963 | Cousteau et al. | 114/330 |
| 3,163,985 | 1/1965 | Bouyoucos | 60/51 |
| 3,333,771 | 8/1967 | Graham | 237/1 |
| 3,418,818 | 12/1968 | Vincent et al. | 405/190 |
| 3,504,648 | 4/1970 | Kriedt | 114/330 |
| 3,519,021 | 7/1970 | Wiswell | 405/186 X |
| 3,813,036 | 5/1974 | Lutz | 237/2 R |
| 3,815,573 | 6/1974 | Marcus | 405/186 X |

*Primary Examiner*—David H. Corbin
*Attorney, Agent, or Firm*—D. Schron

[57] ABSTRACT

Apparatus for supporting the life, safety, comfort, and usefulness of an underwater diver by pumping seawater, or other ambient water in which the diver may be located, under pressure from a surface site to the submerged diver site, and locally converting by hydraulic friction at the diver site the hydraulic energy of such pressurized pumped seawater into diver-warming heat or/and mechanical energy for operating tools, pumps, etc.

7 Claims, 7 Drawing Figures

DIVER SUPPORT APPARATUS

RELATED APPLICATION

This application is a continuation-in-part of application Ser. No. 733,744, filed Oct. 19, 1976 now abandoned.

BACKGROUND OF THE INVENTION

1. Field of the Invention

Diver heating and work energy apparatus.

2. Description of the Prior Art

Presently a common method of heating a diver while submerged and ambulatory involves the heating of water at a diver-remote site and the pumping of such hot water to the diver for circulation through conduits in his diving suit, as in U.S. Pat. No. 3,519,021 to Wiswell, Jr. This usually is in addition to transmitting power to him for operating work tools when required. Transmission of such hot water to the diver occurs by way of a flexible hose that is subjected at its exterior to the low temperature ambient water which tends to provoke considerable thermal loss. The use of thermal insulation around the hot water hose tends to render the hose bulky and difficult to manipulate.

Preliminary novelty search in the U.S. Pat. and Trademark Office has uncovered several patents that disclose the power-generation use of seawater to a limited extent and for a short duration on an emergency basis by flow from the exterior to an interior chamber in a submerged vessel: U.S. Pat. Nos. 3,504,648 Kriedt; 3,418,818 Vincent el al; 3,163,985 Bouyoucos; and 3,003,448 Gay Jr. One, 3,103,195 to Cousteau et al, discloses use of bottled-gas-driven seawater pumps for vessel propulsion, and another, 1,466,315 to Thorsen, operates an hydraulically driven hull scrubber device that uses the deck water conduit on the ship being scrubbed.

A number of patents disclose apparatus for generation of heat from flow hydraulic fluid in a closed loop through a friction means; U.S. Pat. Nos. 3,813,036 to Lutz for a residential heating system; 3,333,771 to Graham for a belt joint vulcanizer; 2,764,147 to Brunner for an aircraft hydraulic system heater; and 2,107,933 to Crockett et al for a system for heating buildings, vehicles, compartments, etc.

One patent, U.S. Pat. No. 3,815,573 to Marcus, discloses a compressed-gas-operated vortex-tube type heat generator for heating a diver's suit by circulation of hot liquid through a gas-to-liquid heat exchanger. The gas used is the bottled breathing gas carried by the diver, or furnished as breathing air via line from the surface.

SUMMARY OF THE INVENTION

The present invention, in transmitting relatively low temperature pressurized seawater to the diver for conversion into heat, rather than high temperature hot water, greatly reduces the potential thermal loss via the heat supply hose and obviates need for cumbersome thermal insulation of the hose. The use of seawater, or other ambient water, as the case may be, for transmission to the diver is expedient, inasmuch as it is readily available and locally exhaustible without polluting.

The use of seawater for tramsmission to the diver also is relatively practical, as compared to the use of compressed gas for such transmission. The column of seawater in the downwardly extending supply hose develops the same hydrostatic elevation pressure as that of the surrounding sea, so that the liquid pumping means at the surface need deliver only that work required to overcome friction in the supply hose, plus any pressure head needed for the intended work function at the diver site. Pumping pressurized gas, on the other hand, requires compression of the gas just to enable it to overcome the hydrostatic head of the water column tending to be forced into the lower end of the hose. At diver depths of many hundreds of feet, such energy-demanding hydrostatic-head-overcoming gas compression can be considerable. At the same time, expansion of compressed gas for creation of heat or performing work results in cooling of such gas to a relatively low temperature at its exhaust. This, coupled with a low ambient water temperature can lead to complication of the equipment in behalf of avoiding freeze-up.

Figure 4:
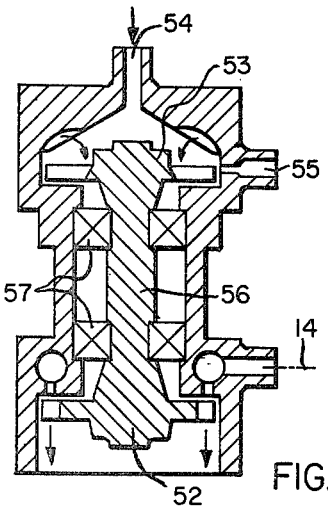
Figure 3:
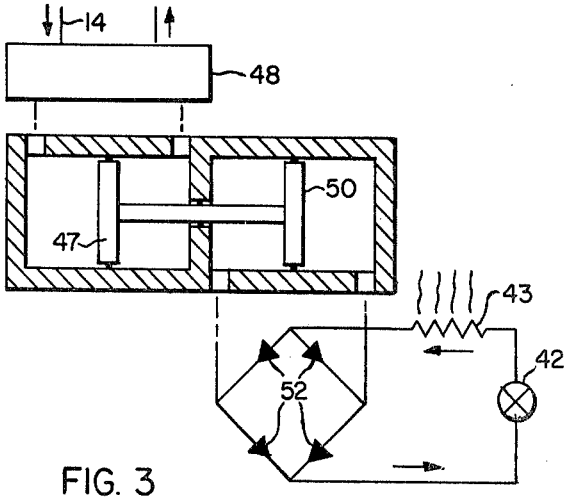

FIGS. *2a* to *2d* are schematic showings of different hydraulic circuit arrangements which may be embodied in the apparatus of the present invention to produce heat at the diver site by flow of seawater under pressure to such site from a surface site;

FIG. 3 is a schematic showing of a reciprocating-piston motor and pump arrangement suitable for embodiment in such as the exemplified hydraulic circuits of FIGS. *2a* to *2d*; and FIG. 4 is a longitudinal cross section view of a rotary hydraulic motor and pump construction suitable for use in the present invention as an alternative to the reciprocating-piston motor-pump used in the FIG. 3 arrangement.

DESCRIPTION OF THE PREFERRED EMBODIMENTS

Figure 1:
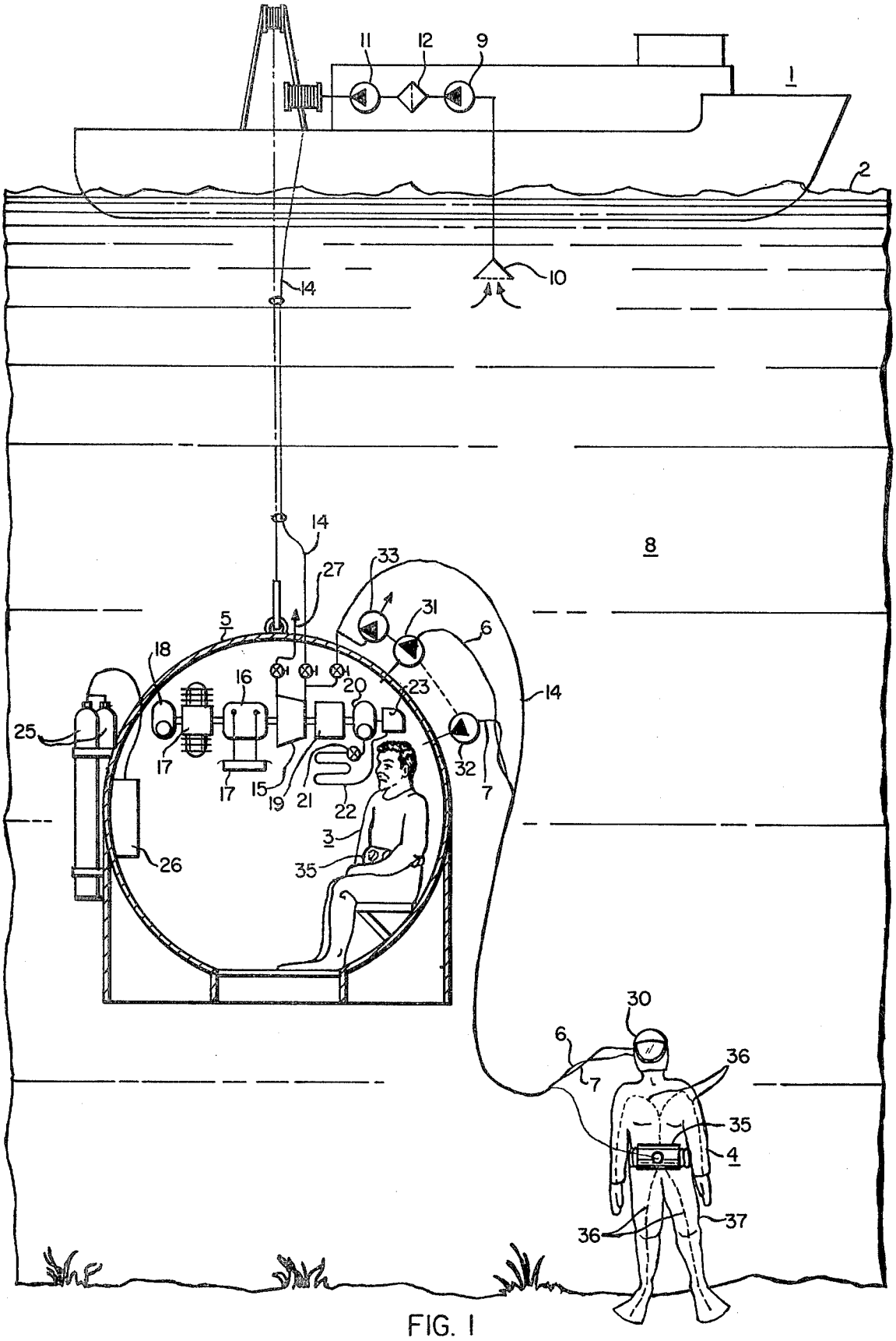
FIG. 1 is an elevation view, partly in outline and partly in section, of an illustrative embodiment of the present invention as affiliated with several divers at two different submerged sites as availed with seawater under pressure from a support vessel at the surface.
Figure 2A:
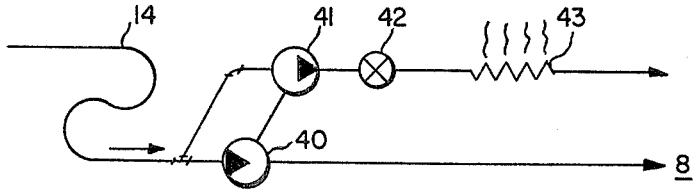
Figure 2B:
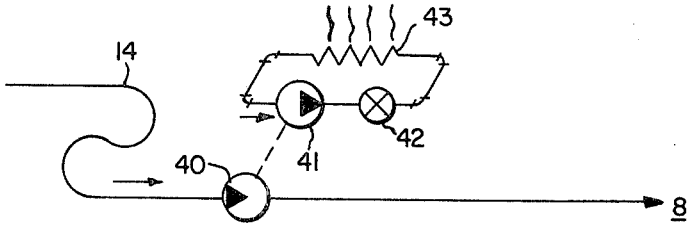
Figure 2C:
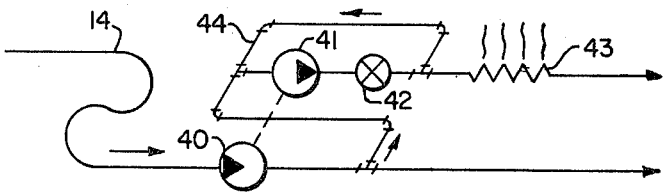
Figure 2D:
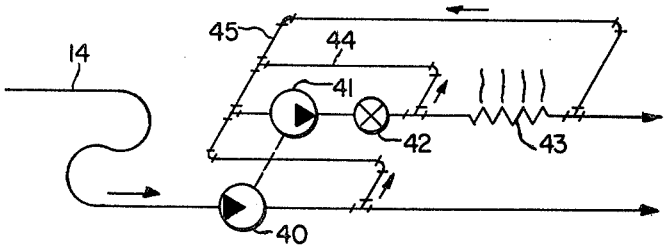

Referring to FIG. 1 the diver support apparatus of the present invention is shown affiliated with a support vessel 1 floating on a sea surface 2 above submerged divers 3 and 4 at two different underwater sites; one being located within a submerged breathing chamber 5 and the other being outside such chamber and furnished with breathing gas from the chamber by way of push-pull breathing gas lines 6 and 7, respectively.

According to the present invention, water from the body of ambient water 8 in which the chamber 5 and divers 3 and 4 are submerged is drawn into a precharge pump 9 via a filter-inlet 10, thence to a supply pump 11 via a filter 12 for pressurizing and delivery to breathing gas chamber 5 and to diver 4 via a pump outlet 13 and a flexible pressurized water supply line 14 and branches thereof.

At the breathing chamber 5, the pressurized seawater arriving via supply line 14 will flow through such as a seawater-operated turbine 15, or other suitable hydraulic motor, to operate such as an electric generator 16 to energize lighting means 17', for example; a gas compressor 17 for operating pneumatic equipment, for example; a hydraulic pump 18 for operating hydraulic equipment, for example; a gas circulation blower 19 for circulating breathing gas within the chamber; and a heat-producing conversion means including a pump 20 for closed-loop circulation of liquid sequentially through a flow restricting means 21 to create hydraulic friction heat within such liquid and then through a heat exchanger 22 to transfer such heat to the interior of such chamber, in accord with the present invention. A hot liquid return chamber 23 completes the heating liquid loop through the pump 20.

The interior of the chamber 5 can be availed with breathing gas, such as a mixture of helium and oxygen, from storage tanks 25 mounted outside the chamber and regulated automatically to maintain a desired oxygen level by gas control means 26 that includes a scrubber means for removal of carbon dioxide from the chamber gas. A diver, such as the diver 3, disposed within the chamber 5 site, is free to remove his helmet, mask, or headgear and breathe the gas within the chamber, as is well known in the art and, in accord with the present invention, to be availed of heat, or/and lighting, pneumatic power, hydraulic power, etc., produced by the flow of low temperature seawater under pressure from the surface site at vessel 1 to the turbine 15. Discharge of seawater from the turbine 15 is free to occur into the sea 8 via an exhaust line 27.

At another site the diver 4 is availed of breathing gas from the interior of the chamber 5 such as by way of the supply and return lines 6 and 7, his diving helmet 30 and suitable valve means (not shown). In accord with adjunctive features of the present invention, supply and return pumps 31 and 32 for the breathing gas lines 6 and 7, respectively, can be driven by a hydraulic motor 33 operated by the low temperature seawater under pressure from a branch of the supply line 14. At the same time, another branch of such pressurized seawater supply line 14 extends to the diver 4 at a site outside the chamber 5 to a hydraulically operated heat-producing conversion device 35. Device 35 is designed to be compact, lightweight, and efficient, for disposition on the diver, such as at his waist, as shown, or at any other suitable location at the diver. Device 35 contains a means for converting flow of the low temperature pressurized seawater from the line 14 into heat, and for passing a liquid medium containing such heat through passage 36 in the diver's suit 37 to maintain comfort and warmth of the diver. The heated liquid medium supplied to the heating passages 36 in the diver's suit 37 may be the seawater or it may be a secondary liquid. Different hydraulic heat-producing-conversion-means circuits suitable for use in the apparatus of the present invention are shown in FIGS. 2, 3, and 4. Some may be more suitable for use at the diver site within the breathing chamber 5, while others may be more suitable for use at the external diver site mounted on the diver.

For example, referring to FIG. *2a*, the circuit disclosed therein includes a hydraulic motor 40 operated by low-temperature pressurized seawater from line 14 to drive a pump 41 that forces seawater also from the line 14 through a hydraulic-friction-heat-producing flow restriction means 42 and a heat exchanger 43. Exhaust from the motor 40 and from the heat exchanger may simply bleed into the sea 8.

Referring to FIG. *2b*, a hydraulic motor 40 driven by low-temperature pressurized seawater from line 14 and exhausting into the ambient water 8 drives a pump 41 that circulates a liquid medium through a closed loop that includes a hydraulic-friction-heat-producing flow restricting means 42 and a heat exchanger means 43.

FIG. *2c* shows an arrangement where part of the discharge from the hydraulic motor 40 serves as input to the pump 41 which forces the seawater through the heat-producing flow restriction means 42 and heat exchanger means 43. Some discharge from the restriction means 42 is allowed to recirculate through the pump 41, however, via a by-pass line 44.

FIG. *2d* is similar to the circuit of FIG. *2c*, but includes an additional recirculation loop line 45 around the heat exchanger 43.

It will be apparent that other hydraulic circuit variations may be employed to advantage to suit particular component characteristics or preferred operating parameters, such as flow-adjusting restrictors, use of recovery heat exchangers, all within the spirit and scope of the present invention.

Several different types of motor-pump combinations may be employed in the foregoing hydraulic circuits. FIG. 3 depicts a reciprocating type in which a motor piston 47 is reciprocably driven by periodic supply of low-temperature seawater under pressure from supply line 14 alternately to its opposite faces under control of a four-way valve means 48, and a pump piston 50 driven by motor piston 47. Pump piston 50 discharges alternately from its opposite faces to force the flow of liquid medium through the hydraulic-friction-heat-creating flow restriction means 42 and heat exchanger means 43 via a system of check valves 52 arranged like a full-wave bridge rectifier in simple AC-to-DC electrical conversion circuitry. By compounding the number of motor and pump pistons, a triplex or quadraplex arrangement can be obtained for smoother discharge flow. The several pump pistons can be made to operate in an out-of-phase relationship to obtain the desired pulsation-reducing effect.

A motor-pump assemblage that appears to be particularly suited for use as the heat-producing conversion device 35 at the diver 4 or the turbine-pump 15—20 combination is shown in FIG. 4. Here the assemblage employs hydraulic motor and pump of the rotary type. A water turbine rotor 52 rotatable about axis **52*a* is driven by pressurized seawater flow from the line 14 to turn a pump rotor 53 that can be, as depicted in FIG. 4, of an inefficient design from a pumping performance point of view, lossy or of high-loss, with such an amount of clearance between the rotor's blades 53*a* and the wall of the chamber 53*b* in which such blades are being turned about axis 52*a* that considerable churning, swirling, or turbulence as indicated by the arrows 53*c*, takes place while such blade rotation induces ingress of liquid medium via a coaxial inlet port 54 and discharge of such medium via a radial outlet 55 after such medium has experienced a heating effect from the hydraulic friction created by the inefficiently operating blades 53*a*. Such heated liquid medium, via inlet 54 and outlet 55, becomes circulated by such operation of the lossy rotor 53** through a heat exchange circuit, such as depicted in FIGS. *2a* to *2d*, where device 35 is represented schematically by the hydraulic motor 40-and-pump 41 combination, and heat passages 36 in the diver's suit 37 are represented by the heat exchanger 43. Non-recirculated, single-pass operation of the pump 41 tends to be inefficient from a heating point of view, excess pressurization and flow of low-temperature pressurized ambient liquid through the hydraulic motor operating the pump.

In lieu of generating the hydraulic friction heat substantially by rotation of the "lossy" rotor 43 depicted in FIG. 4, a close-clearance-bladed rotor of high pumping efficiency may be employed and such heat created substantially entirely by flow through the restricting means 42 in the heating liquid medium circuit.

With adequate flow (2 gpm, for example) and pressure (2000 psi, for example) a device 35 of less than three inches in diameter and less than four inches long can generate heat energy equivalent to several kilowatts, about one hundred btu/minute.

I claim:

1. Support apparatus for a diver at a submerged site in a body of ambient liquid, comprising, ambient liquid pump means at the surface of said body of liquid for pressurizing and displacing ambient liquid from said body, a flexible supply line extending from said pump means at the surface to said submerged site for conveying such pressurized ambient surface liquid downwardly thereto, and heat-producing conversion means at such submerged site connected to receive flow of pressurized ambient liquid from said line and operable to convert the hydraulic flow energy thereof into heat energy capable of maintaining comfort and warmth of such diver.

2. The support apparatus of claim 1, wherein said heat-producing conversion means is affiliated with a submerged chamber containing breathing gas at such diver site.

3. The support apparatus of claim 1, wherein said heat-producing conversion means is diver-worn.

4. The support apparatus of claim 1, wherein said heat-producing conversion means includes a turbine pump.

5. The support apparatus of claim 1, wherein said heat-producing conversion means includes hydraulic flow restricting means.

6. The support apparatus of claim 1, wherein said heat-producing conversion means includes, a hydraulic motor operated by flow of pressurized ambient liquid from said supply line, a liquid flow restricting means, a heat exchanger means, and a pump operated by said hydraulic motor for circulating a liquid medium through said flow restricting means and through said heat exchanger means.

7. The support apparatus of claim 1, further including other means at said submerged diver site operable by pressurized ambient liquid from said supply line.

* * * * *